United States Patent [19]

Weber et al.

[11] 4,260,458

[45] Apr. 7, 1981

[54] COKE OVEN CONSTRUCTION FOR THE CONTINUOUS COKING OF BRIQUETTES FROM HARD OR SOFT COAL OR PEAT

[75] Inventors: Heinrich Weber, Recklinghausen; Kurt Lorenz, Hattingen; Horst Dungs, Herne, all of Fed. Rep. of Germany

[73] Assignee: Firma Carl Still Recklinghausen, Fed. Rep. of Germany

[21] Appl. No.: 964,890

[22] Filed: Nov. 30, 1978

[30] Foreign Application Priority Data

Dec. 17, 1977 [DE] Fed. Rep. of Germany ..... 2756330

[51] Int. Cl.[3] ..... C10B 3/00; C10B 3/02; C10B 29/00; C10B 33/00

[52] U.S. Cl. ..... 202/121; 202/124; 202/126; 202/221; 202/222; 202/228; 202/262; 202/263

[58] Field of Search ..... 202/138–144, 202/227, 228, 230, 262, 120–127, 214, 126, 263

[56] References Cited

U.S. PATENT DOCUMENTS

| | | | |
|---|---|---|---|
| 1,704,686 | 3/1929 | Van Ackeren | 202/123 |
| 1,738,743 | 12/1929 | Van Ackeren | 202/123 |
| 3,054,728 | 9/1962 | Schmidt et al. | 202/144 |
| 3,488,259 | 1/1970 | Gramm | 202/139 |
| 3,730,847 | 5/1973 | Pries et al. | 202/139 |
| 3,801,470 | 4/1974 | Knappstein et al. | 202/142 |

*Primary Examiner*—Michael Marcus
*Attorney, Agent, or Firm*—John J. McGlew

[57] ABSTRACT

A coke oven, comprises a housing having an interior vertically elongated coke oven chamber with a plurality of vertically extending binding walls subdividing the oven chamber into a plurality of heating flues. A nozzle in each of the binder walls between the heating flues discharges a rich gas into each flue. In addition, the binder walls contain respective first and second vertical air ducts arranged in alternate binder walls between the flues with alternate ones of the air ducts having discharges at one or more levels above the others of each binder duct wall and connecting into the flues on each side of the associated binding wall. An air duct supply is connected separately to the alternate ones in each of the other air supply ducts.

7 Claims, 7 Drawing Figures

COKE OVEN CONSTRUCTION FOR THE CONTINUOUS COKING OF BRIQUETTES FROM HARD OR SOFT COAL OR PEAT

FIELD AND BACKGROUND OF THE INVENTION

This invention relates to coke ovens in general and, in particular, to new and useful vertical chamber ovens arranged in batteries for the continuous coking of briquettes from hard coal, soft coal or peat, with heating by heating walls arranged laterally of the oven chambers, which are subdivided by binder walls into individual heating flues and to which fuel gases are fed through foot nozzles and combustion air through vertical ducts in the binder walls and through lateral slots originating from the ducts and leading to the heating flues at several levels, as well as an offtake in the upper range for the coke oven gases.

DESCRIPTION OF THE PRIOR ART

In German Patent Application No. P 26 57 213.4, vertical oven chambers arranged in batteries with coal hoppers, locks and delivery means for the glowing coke are suggested, as well as heating walls arranged between the oven chambers with heating flues and regenerators or recuperators arranged laterally thereof for preheating the heating media and for cooling the heating gases. The vertical oven chambers are provided with heating walls on both sides which are subdivided by binders into individual vertical heating flues are provided for the fuel media.

Rich gases or lean gases can be introduced into the heating flues from the bottom through nozzles and the combustion air is introduced at different levels of the heating flues through ducts in the binders and slots leading from the binders into the heating flue. A battery with vertical oven chambers wherein the heating is effected by heating walls with vertical heating flues into which the combustion air is introduced at different levels is also described in German Pat. No. 1,952,621 (See FIG. 4).

The known vertical chamber batteries are suitable for the continuous or discontinuous coking of coal with good coking properties which require merely fine grinding as a preparation for the coking. These coals are introduced, for example, from the top into the oven chambers, and the glowing lumpy coke is withdrawn from the bottom and quenched.

In the coking of fine-grained, barely-caking or non-caking hard coal, soft coal or peat in the known vertical chamber ovens, it is not possible to produce lumpy coke. However, these fine coals require preliminary treatment. One type of preliminary treatment consists in first pressing the fine coals into briquettes with water, tar bitumen or other binders. In order to avoid great losses in strength during the subsequent coking of the "green" briquettes, and in order to maintain the briquette form during the thermal treatment, special temperature gradients must be maintained over certain periods so that the briquettes do not show internal stresses which cause disintegration.

A particularly careful thermal treatment is required for briquettes from moist coal in the preheating and drying stage. However, during coking also, the briquettes require careful treatment, regardless of the type of coal used or the manner in which it is produced. Special temperature gradients must, therefore, be maintained which cannot be obtained in the known vertical chamber ovens.

The treatment of soft coal briquettes for preheating and drying in various stages with direct heating and by maintaining certain temperature intervals and certain steam pressures in the preheating and drying gases is known, for example, from German Pat. Nos. DAS 2,507,735 and DAS 2,537,191. As a continuation of the underlying concept of the above-described patents for the preheating and drying stage, a special design of the coking stage should also be possible with which certain temperature gradients can be maintained during coking in order to reduce the mechanical stress on the briquettes to a minimum.

SUMMARY OF THE INVENTION

The present invention provides an indirect heat supply for coking the preheated and predried briquettes and, for this purpose, vertical chamber ovens are arranged in batteries in such a way that, with an effective height of 10 m to 20 m, and particularly 10 m to 15 m, two feed ducts for combustion air are arranged under the heating walls. The binder wall ducts of adjacent heating flue binders are connected alternately with one or the other feed duct. The air slots of adjacent heating flue binder walls are arranged at different levels and all heating flue binder ducts, arranged in the upper range of the heating flues, are assigned to the same air feed duct as the air slots arranged in the lower range.

According to the invention, it is possible to produce and maintain certain temperature profiles over the entire height of the oven chambers and to set the temperatures that are indispendable for gentle coking in the upper range of the oven chambers. A typical heating flue temperature distribution curve over the height obtained according to the invention, e.g., with the use of soft coal briquettes, is shown in FIG. 1. The maintenance of these temperatures yields the desired gentle coking of the briquettes and abrasion-resistant, hard briquettes are obtained.

The bottom air feed slot is arranged approximately at the level of the foot nozzle end and lateral intervals of 800 mm to 1000 mm are maintained between the various air slots of a binder. The same interval is also maintained between the group of the lower and upper air slots of two adjacent binders. With a height of 10 m of the heating flue, each binder has two vertically spaced air slots. With greater heights, their number increases, and with a height of 15 m, three vertically spaced air slots are provided for each binder.

According to the invention, it is possible to increase the temperature of the dried briquettes in the upper third of the oven chamber to about 350° C. to 450° C. In the second third, the temperature is increased to about 800° C. to 900° C. and, in the last third, to about 1000° C. In this way, coke briquettes which are both hard and pressure-proof are obtained.

By grinding the sharp-edged outflow edge at the end of the central flue gas nozzle and by arranging the air slots in the heating flue binders obliquely, it is possible to achieve an intensive mixing of the two combustion media fuel gas and air, and to confine the combustion to substantially the height range in which the heat consumption for coking the briquettes is high, while further up and down, the temperature gradients decrease and thus, the gentle heating of the briquettes.

If gases of high calorific value containing hydrocarbons with a tendency to cracking are used for heating, the fuel gas feed duct can also be provided with heat insulation. Finally, air can be injected from time to time through the fuel gas nozzles into the heating flues to control the temperature. To this end, the heating gas feed is provided with a connection to an air line, while all safety devices are maintained. It is also possible to effect the temperature control by sliding blocks arranged in a known manner at the transitions from the heating flues in an upper horizontal duct for the exhaust of combustion gases.

The coked briquettes can now be cooled in any desired manner.

According to the invention, a special coke cooling device, comprising refractory steel, adjoins the coking chamber directly without a special transition, and lateral gas outlets for the heated cooling gas are distributed over the entire length of the chamber in regular intervals at the upper end of the cooling stage for a cooling gas cycle. They consist of recesses in the cooling chamber wall and are adjoined by gas outlet ducts. The transverse gas outlet ducts pass over into a longitudinal duct which is dimensioned so that the velocity of the gas is less than 1 m/sec and the entrained dust can settle in a lower conical part of the longitudinal duct.

This lower conical part is preferably designed as a trough, on which a conveyor device for the dust is arranged. The collected dust is discharged from the coke cooling system through known sluices. The cooled coke issues at the bottom end of the cooling stage through specially designed flues and gas-tight sluices, drops onto clearing tables, and is cleared and evacuated with known clearing- and conveyor means.

The cooling gas, free of dust, is cooled in a heat-exchanger in which the combustion air for heating the battery can be preheated. The circulated cooling gas is surprisingly a hydrogen-rich heating gas and is in contrast to the coke oven gas proper, which is withdrawn at the top from the vertical chambers. It contains, including the so-called heavy hydrocarbons, e.g., about 68% hydrogen and about 27% carbon monoxide (% by volume) and its lower calorific value is about 2720 kcal/$Nm^3$.

The coke oven gas on the otherhand consists of about 33% hydrogen, about 22% carbon monoxide and about 22% methane, and its calorific value is about 3550 kcal/$Nm^3$ (including the heavy hydrocarbons).

With the apparatus according to the invention, it is possible to withdraw a hydrogen gas continuously from the cooling cycle, which can be used for any desired purpose. Gas losses of the cooling cycle are covered by the supply of gases from the bottom part of the coking stage. The balance between losses and gas withdrawals from the circuit can be achieved by corresponding adjustment of the pressures.

The heating of the coking stage is normally achieved with the coke oven gas from the coking stage which is fed after cooling and cleaning, to the rich gas nozzles of the heating flues for combustion, but the hydrogen-rich gas which is withdrawn from the cooling gas cycle can also be used for this purpose. To this end, it is sufficient to provide a gas outlet from the cooling gas cycle which is connected to the fuel gas supply of the battery.

The briquettes to be coked are, for example, dried briquettes, preheated to 150° C., which are produced from most fine coals with or without binders, or those produced from dry fine coals with crude tar, for example, as a binder. So-called "hot briquettes" which already have an inherent temperature of about 420° C., from their production process, can also be used. This higher inlet temperature of the briquettes then takes the temperature control in the vertical chamber into account.

Briquettes of soft coal, hard coal, peat or mixtures of these substances can be used. The drying of fine coal can be effected, for example, in a flying stream dryer. This type of drying is preferred if a part of the grinding is to be done this way, since an additional comminution effect is produced.

Accordingly, an object of the invention is to provide a coke oven for the continuous coking of briquettes from hard coal, soft coal or peat, which includes a plurality of heating walls or binder walls which subdivide the coke oven into a plurality of vertically elongated heating flues and which include nozzles in each binder wall for discharging rich gases either directly into the flues or into air ducts which are arranged in each of the binder walls, and wherein, alternate ones of the air ducts have discharges into the flues at different levels than the others and are separately connected to an air supply duct.

A further object of the invention is to provide a coke oven for the continuous coking of briquettes from hard or soft coal or peat, which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
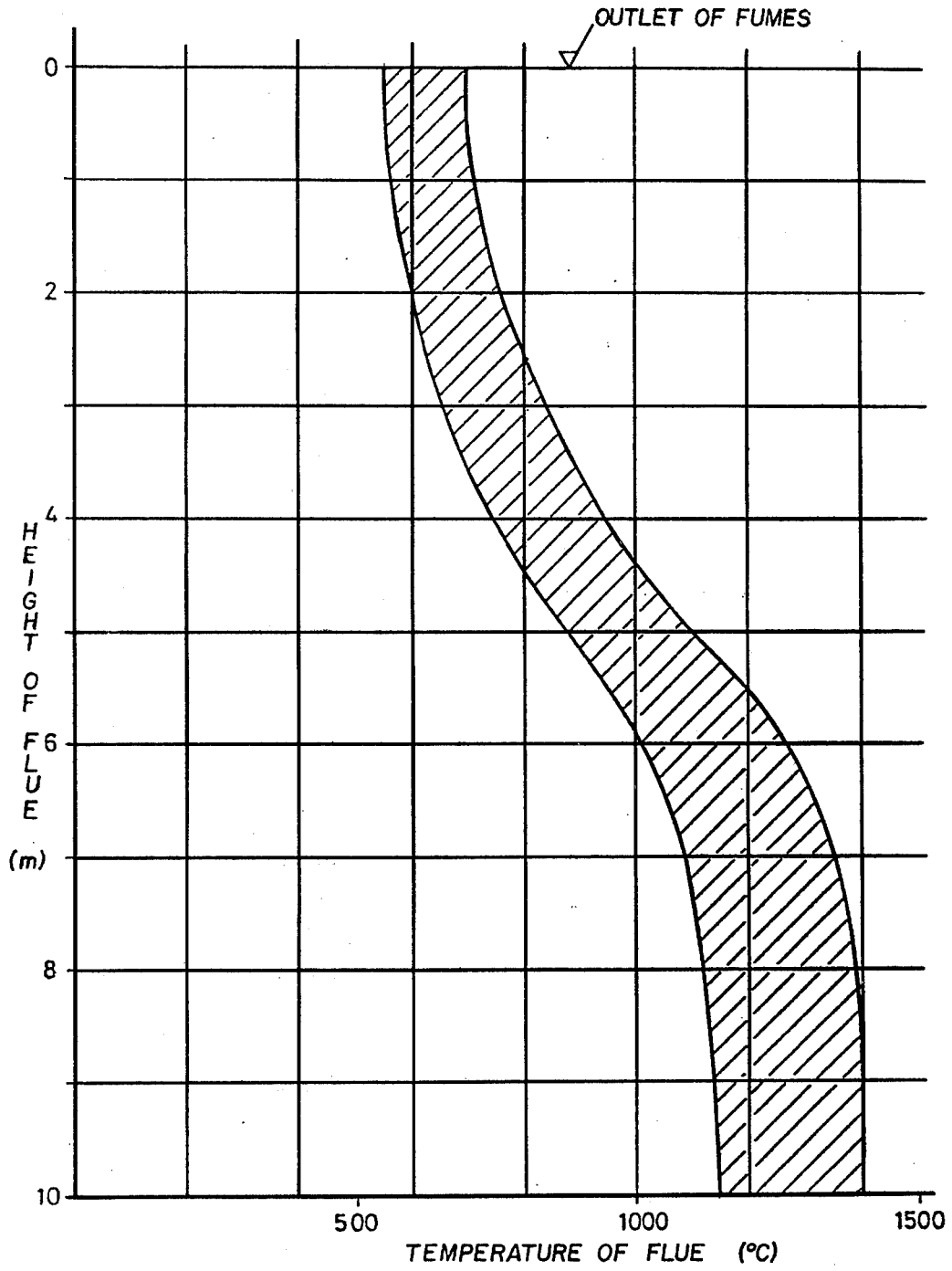
FIG. 1 is a diagram indicating the temperature gradient over the height of the heating flue with a coke oven constructed in accordance with the invention and using soft coal briquettes.
Figure 3:
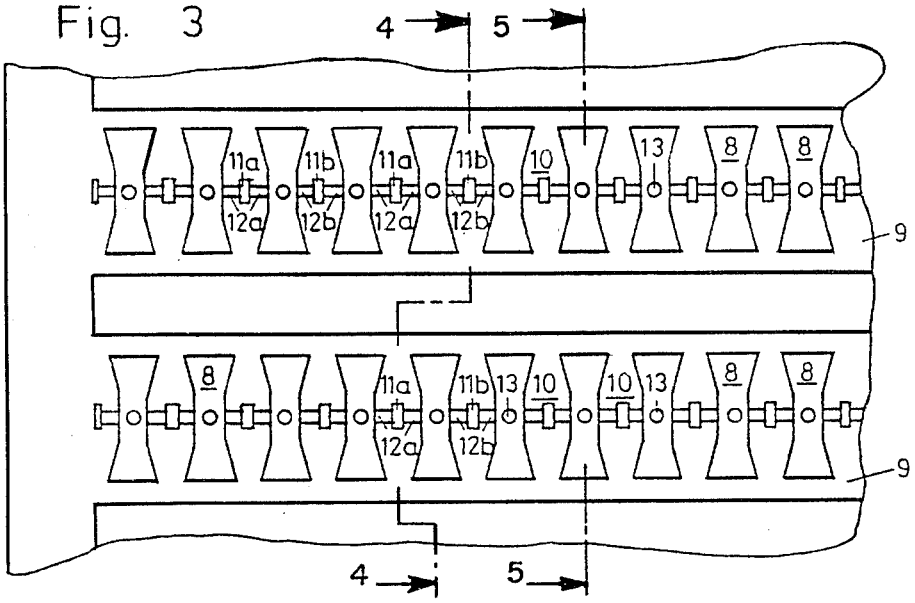
FIG. 3 is a horizontal section taken along the line 3—3 of FIG. 2*a;*
Figure 2A:
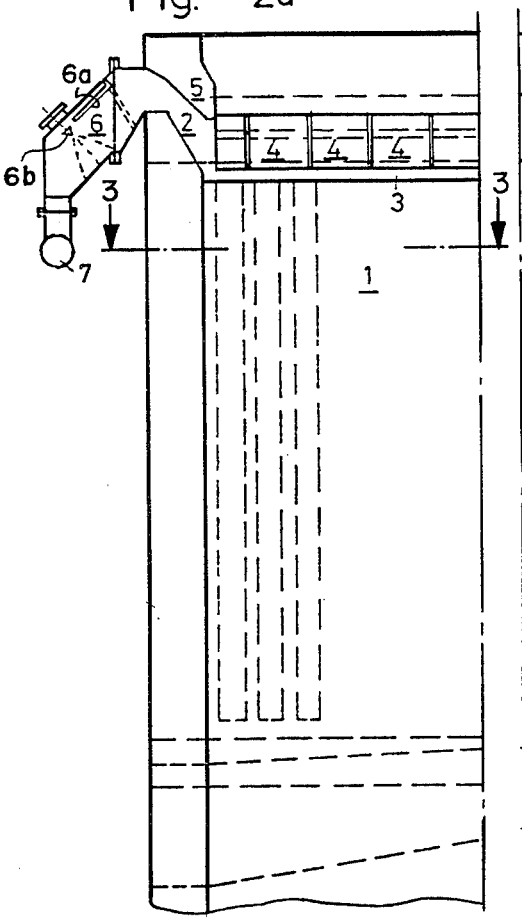
FIG. 2*a* is a partial, longitudinal sectional view, through a vertical coking oven chamber, indicating the lefthand side thereof.
Figure 2B:
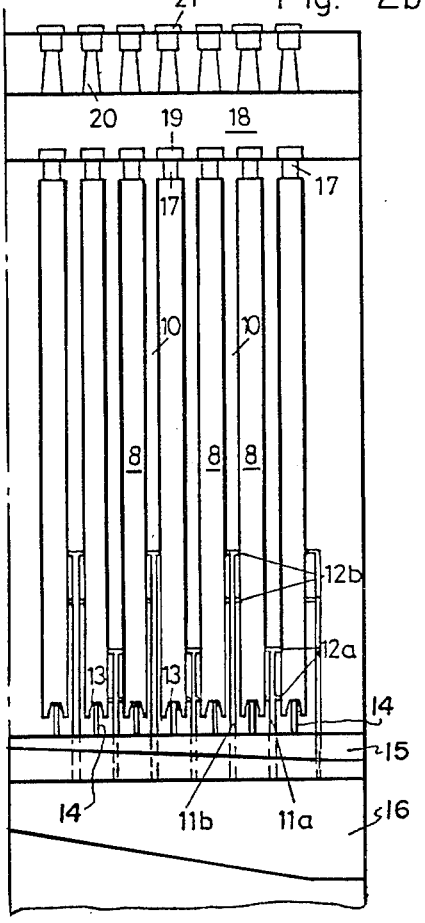
FIG. 2*b* is a view similar to FIG. 2*a* indicating the right side portion of the coke oven.

Referring to the drawings in particular, the invention embodied therein, comprises a coke oven which, as seen in FIGS. 2*a*, 2*b*, 3 and 4, includes a plurality of coke oven chambers 1, an exhaust port 2 for coke oven gases, which connects with a covered longitudinal duct 3 arranged at the upper end of the individual flues 8 which are separated from heating flue binder walls 10. A plurality of vertically elongated heating flues 8 are arranged side-by-side supplied with a rich gas through a rich-gas feed duct 15 which communicate therewith, through gas connecting ducts 14 at the lower ends of the binder walls, for discharge through nozzles 13 into the lower ends of the heating flues 8.

In addition, in accordance with the invention, air is fed through an air duct 16 which separately and alternately connects with either first air feed binder ducts 11*a* or second air ducts 11*b*. The first air feed ducts 11*a* extend upwardly in the binder walls 10 between adjacent flues and have slot discharges 12*a* which feed into the heating flues 8 on each side at two separate levels. The second air feed ducts 11*b* have discharges 12*b* into the flues on alternate sides of the binder walls with which they are associated at two levels which are higher than the levels of the ducts 11*a*. The heating gases which move up through the heating flues are collected in a horizontal offtake 18. A nose 5 projects into the oven and deflects any briquettes which may tend to exit into the gas outlet 6.

Gas outlet 6 includes a bend with a locking device 6*a* and an injection nozzle 6*b* through which a cooling liquid is directed into the outlet. Gas outlet 6 opens into a receiver 7. The binder walls which border the flues 8 are referred to the heating walls 9. The flue binders 10 define the binder air ducts 11*a* and 11*b*. Air is fed directly into the air feed duct 16 which has separate passages for connecting separate ducts 11*a* and 11*b*. Opening 17 from the heating flue 8 leads to the horizontal offtake 18. Regulating blocks 19 are positioned to control the flow of the heating gases upwardly into the horizontal offtake 18. Inspection holes 20 are provided with observation means 21 which make it possible to control the temperature in the heating flues 8 by observation.

Figure 4:
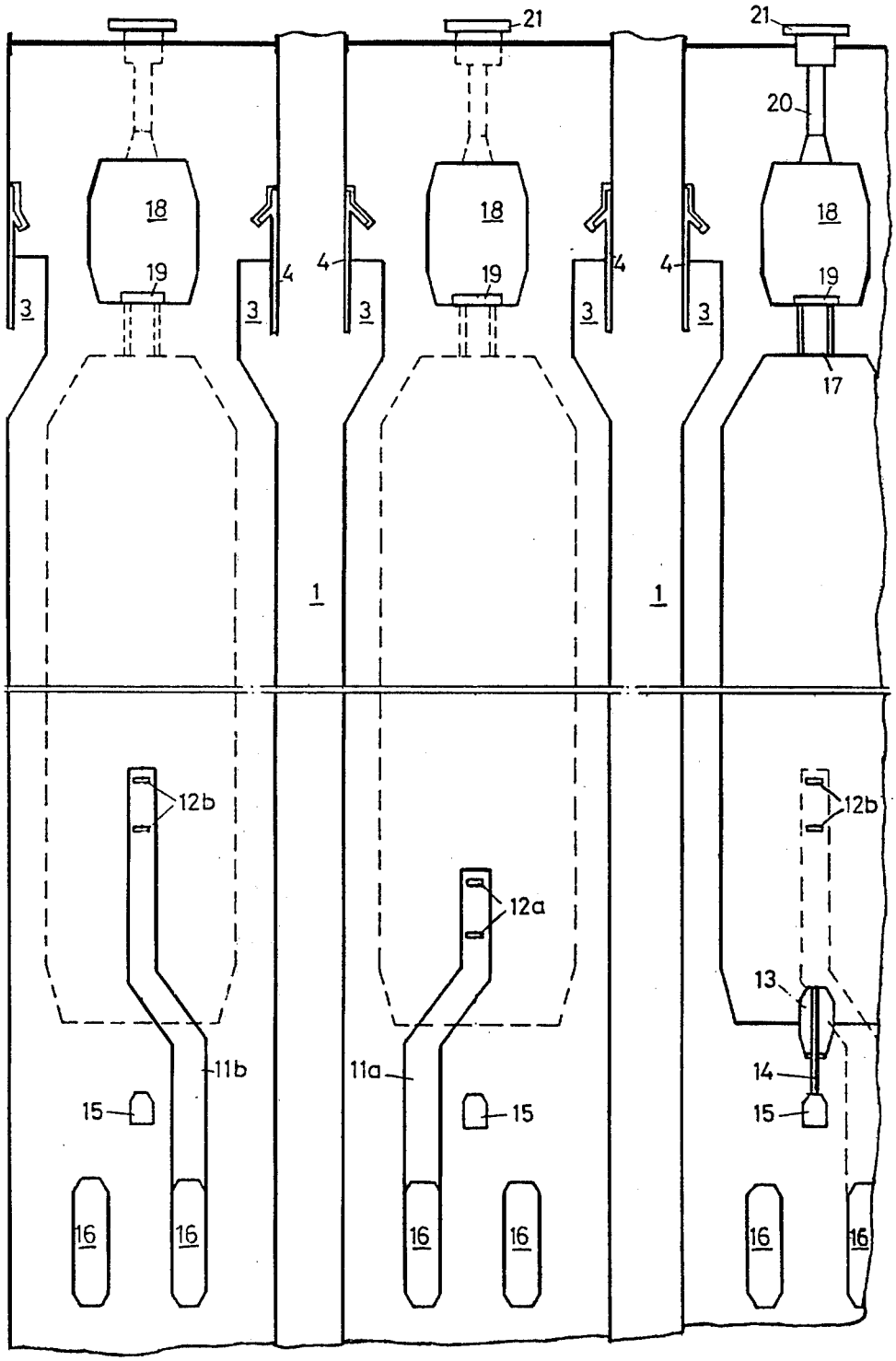
FIG. 4 is a vertical section taken along the line 4—4 of FIG. 3.

FIG. 4 shows the air supply to the heating flues in detail and the evacuation of the burned heating gases.

Figure 5:
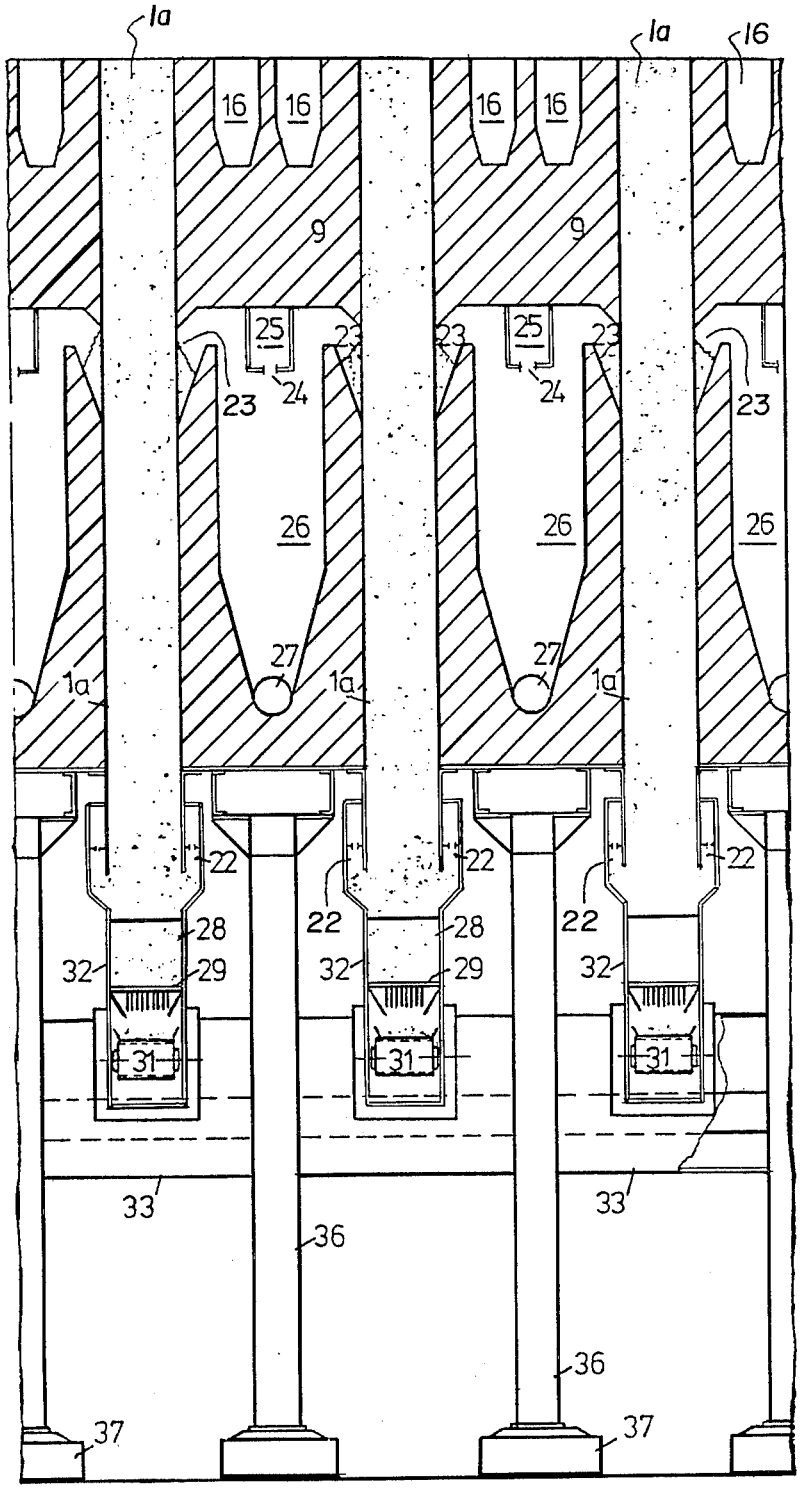
FIG. 5 is a vertical section through the cooling stage taken along the line 5—5 of FIG. 3.

In FIG. 5, cold gas supply pockets 22 are shown for cooling the coke in a cooling chamber 1*a*. Cooling gas becomes heated during the cooling process and is permitted to pass out through exhaust ports 23. The cooling gases are exhausted through openings 23 which are uniformly distributed over the length of the chamber. The hot cooling gases flow through groove openings 24 into a horizontal collecting flue 25. The construction includes a trough-shaped bottom part 26 disposed below the collecting flue 25 for the removal of dust which is effected by a conveyor screw 27 located at the bottom of the trough-shaped bottom part 26.

Figure 6:
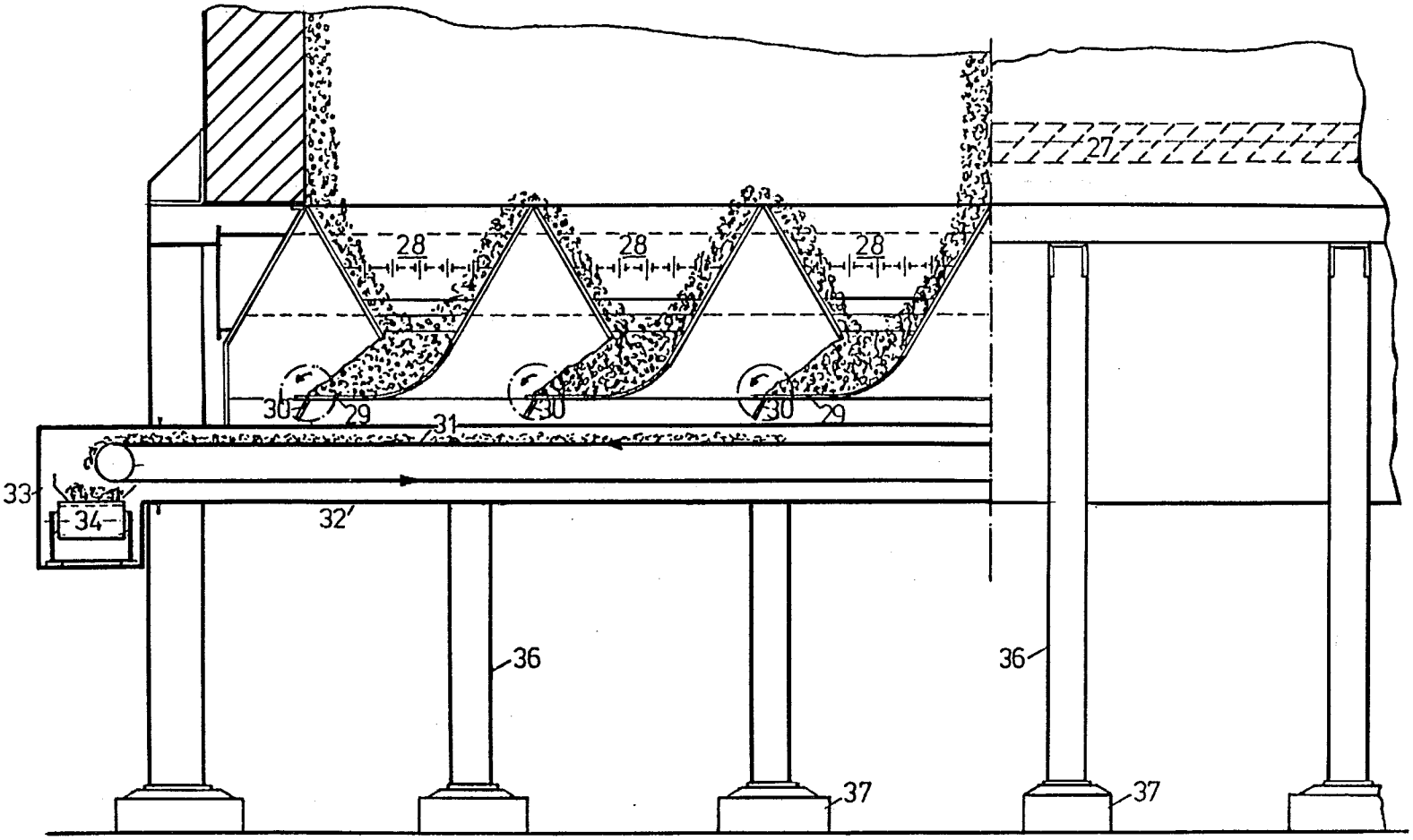
FIG. 6 is a partial longitudinal sectional view through the cooling stage of the coke oven below the portion indicated in FIG. 2*a.*

The lower ends of the cooling chamber 1*a* are provided with discharge pockets 28 which terminate in horizontal plane surfaces 29 which are shown in both FIGS. 5 and 6. Rotating forks 30 are carried on these surfaces and they move in a counterclockwise direction, as indicated by the arrow, to regularly direct the coke out of the discharge pockets 28 and onto a conveyor 31. The rotating forks operate to insure a uniform sinking of the coke material over the entire length of the oven chamber. This is a prerequisite to the obtaining of a uniform height and temperature profile over the entire height of the oven chamber.

The conveyor 31 moves the coke into a cross-duct 33 having a transfer conveyor 34 which receives the coke of the entire battery and conveys it for removal from the plant. This coke is cooled coke which has a temperature of about 30° C. in the discharge pocket 28 and can thus be safely exposed to atmosphere. The coke oven is supported by columns 36 and baseplates 37 on a suitable foundation structure.

The vertical chamber ovens of the invention can be made at a height of 10 m and more without any difficulty in respect to the fastening thereof. Such ovens are also called high capacity coking ovens.

While a specific embodiment of the invention has been shown and described in detail to illustrate the application of the principles of the invention, it will be understood that the invention may be embodied otherwise without departing from such principles.

What is claimed is:

1. A coke oven of the type having means with bottom discharge for the continuous vertical coking of briquettes from hard coal, soft coal or peat, comprising a housing having at least one heating wall dividing the coke oven chambers into a plurality of parallel interior vertically elongated coke oven chambers, said heating wall having portions between adjacent chambers defining a plurality of vertically extending binder walls and a plurality of individual heating flues therebetween, a nozzle communicating with each of said heating flues for the discharge of a rich gas into each flue, first and second vertical air ducts defined in respective alternate binder walls between said flues and having branch ducts connected to and communicating with said flues, each of said branch ducts of the respective vertical air ducts having a discharge for the discharge of air into said flues at vertically spaced locations, said first vertical air ducts having vertically spaced discharges into the flues on each side of the associated binder wall at height levels which differ from the vertically spaced discharges of said second vertical air ducts of the adjacent binder walls into the same flues in a heating wall portion between adjacent chambers, air duct supply means connected separately to the air ducts in the alternate binder walls, said coking chamber having means at a lower portion thereof defining a cooling chamber below said heating flues in communication with said coke oven chambers for cooling the briquettes, said heating walls having means defining a gas collecting chamber in the lower portion of said heating wall adjacent to said cooling chamber, said gas collecting chamber means defining a collecting flue therein and exhaust ports in the walls defining said collecting chamber for discharging heated cooling gas from said cooling chamber to said collecting flue, said gas collecting chamber and said collecting flue disposed parallel to said cooling chamber, said collecting chamber having a trough-shaped bottom part disposed below said collecting flue tapering downwardly to the bottom thereof for the collection of dust therein, a dust conveyor at the bottom of said trough-shaped bottom part for conducting away the dust collected therein and means for supplying a cooling gas to said cooling chamber below said exhaust parts.

2. A coke oven, as claimed in claim 1, wherein said heating flue has a height of ranging from 10 m to 20 m and each air duct has three air slots arranged at three different levels.

3. A coke oven, as claimed in claim 1, wherein each of said heating flues has a height ranging from 10 m to 15 m, and each air duct has two air discharges at different height levels.

4. A coke oven, as claimed in claim 1, including a gas branch for rich gas supply connected to said cooling gas inlet.

5. A coke oven, as claimed in claim 1, wherein said cooling chamber includes lower ends with discharge pockets having horizontal surfaces, a rotating fork movable through said surface to direct the coke off the surface for discharge at a rate to ensure sinking of the coke material over the entire length of the oven chamber.

6. A coke oven, as claimed in claim 1, wherein the lowest one of the branch ducts of said first and second vertical air ducts is substantially at the level of the discharge of said nozzle and wherein there is a vertical spacing of from 800 mm to 1000 mm between the discharge of said branch ducts in each binder wall and between the discharges of a branch duct opposite to the discharge of a branch duct in said alternate binder wall.

7. A coke oven, as claimed in claim 1, wherein each of said air ducts includes an obliquely extending portion having a discharge into said flues and said nozzle includes a sharp-edged outflow edge to achieve an intensive mixing of the rich gas and air.

* * * * *